US007252546B1

(12) United States Patent
Holland

(10) Patent No.: US 7,252,546 B1
(45) Date of Patent: Aug. 7, 2007

(54) COAXIAL CABLE CONNECTOR WITH REPLACEABLE COMPRESSION RING

(76) Inventor: Michael Holland, 107 Via Del Cielo, Santa Barbara, CA (US) 93109

( * ) Notice: Subject to any disclaimer, the term of this patent is extended or adjusted under 35 U.S.C. 154(b) by 0 days.

(21) Appl. No.: 11/497,187

(22) Filed: Jul. 31, 2006

(51) Int. Cl.
*H01R 9/05* (2006.01)

(52) U.S. Cl. ..... 439/584

(58) Field of Classification Search ..... 439/578, 439/583–585

See application file for complete search history.

(56) References Cited

U.S. PATENT DOCUMENTS 6,767,248 B1 * 7/2004 Hung ..... 439/578
7,018,235 B1 * 3/2006 Burris et al. ..... 439/584
7,118,416 B2 * 10/2006 Montena et al. ..... 439/584

* cited by examiner

*Primary Examiner*—Tho D. Ta

(74) *Attorney, Agent, or Firm*—Michael G. Petit

(57) ABSTRACT

A male compression-type coaxial cable connector having an adapter nut attached to a leading end of a tubular connector body portion. The connector body portion has a first axial conduit with a barbed ferrule coaxially mounted therein. The connector further comprises a compression sleeve having a second axial conduit slidingly disposed over a trailing end of the tubular connector body portion. A deformable compression ring is removably disposed within the second axial conduit. In use, the prepared end of the coaxial cable is inserted through the compression sleeve and compression ring and advanced into the connector body conduit until it can be advanced no further. Subsequent advancement of the compression sleeve over the connector body portion, with the assistance of a compression tool, forces the deformable trailing end of the compression ring radially inward to compress the cable jacket and braid thereby providing secure attachment of the connector to the cable. The compression ring is removable and can be replaced with another compression ring having a different inner diameter to accommodate a variety of coaxial cables. The construction permits the compression sleeve to be easily removed for replacing the compression ring and easily reinstalled over the connector body after ring replacement.

1 Claim, 2 Drawing Sheets

COAXIAL CABLE CONNECTOR WITH REPLACEABLE COMPRESSION RING

BACKGROUND OF THE INVENTION

1. Field of the Invention

The present invention relates to male coaxial cable connectors operable for electrically connecting a center conductor in a coaxial cable to a mating female port.

2. Prior Art

Connectors adapted to form a secure, electrically conductive connection between a coaxial cable and a threaded female port have are well known in the art. Such prior art connectors are discussed, for example, in U.S. Pat. No. 6,217,383 to Holland et al., U.S. Pat. Nos. 6,676,446, 6,153,830 and 6,558,194 to Montena, U.S. Pat. No. 5,024,605 to Ming-Hua, U.S. Pat. No. 4,280,749 to Hemmer, U.S. Pat. No. 4,593,964 to Forney, Jr. et al., U.S. Pat. No. 5,007,861 to Stirling, U.S. Pat. No. 5,073,129 to Szegda, U.S. Pat. No. 3,710,005 to French and U.S. Pat. No. 5,651,699 to Holliday. U.S. Pat. No. 5,879,191 to Burris, discusses prior art efforts to provide a coaxial connector which is moisture-proof and minimizes radiative loss of signal from the cable. A radial compression type of coaxial cable connector of the type generally used today, is described in detail in U.S. Pat. No. 5,632,651 to Szegda, and the disclosure and discussion of the prior art of Szegda '651 relating to radial compression coaxial cable connectors is incorporated herein by reference thereto While the innovative plethora of prior art connectors, some of which are disclosed above, provide improved moisture sealing and/or RF leakage characteristics, all have inherent limitations. For example, the integrity of the attachment between the cable and connector is "craft sensitive", depending on the skill of the installer. In order to provide a secure, sealing engagement between a compression-type male coaxial cable connector and a coaxial cable, a series of steps must be performed. Installation of a coaxial cable connector on a coaxial cable requires that the end of the cable first be prepared to receive the connector. The connector is then manually forced onto the prepared end of the cable until the protective jacket and underlying conductive braid of the cable are separated from the dielectric core of the cable by engagement with a tubular shank disposed therebetween. The cable is further advanced into the connector by hand, which requires the application of substantial force by the installer, until the correct depth of insertion is attained. Finally, the connector is securely affixed to the cable by compressing the connector, again by hand, with a compression tool.

With most prior art connectors, during the compression step, the cable jacket and conductive braid are compressed against an annular barb disposed on the outer surface of the aforesaid underlying tubular shank during the final several millimeters of compressive travel. If the installer fails to completely compress the connector, especially in the final 20 percent of the compressive range, the connector may come loose. In addition, if the cable is not fully inserted into the conduit, the connector may come loose and/or the electrical connection may fail. In the above-referenced prior art patents, the compression sleeve is nondetachably attached to the trailing end of the connector body thereby recessing the trailing end of the ferrule or center post within the connector where it is not visible to an installer.

The step of inserting the prepared end of a cable into a connector such that the center post or ferrule on the connector slides between and separates the braided shielding from the dielectric layer of the cable is an art. If the trailing end of the ferrule is recessed too deeply within the trailing end of a connector, it may be difficult to achieve proper alignment in order to accomplish the intended function. Accordingly, there is an advantage to providing a connector wherein the compression sleeve may be detached from the trailing end of the connector body to facilitate visualization of the trailing end of the ferrule and enable proper insertion of the cable into the connector. Rodrigues et al., in U.S. Pat. No. 6,530,807, provides a connector that includes a connector body having a cable receiving end and an opposed connection end. A locking sleeve is provided in detachable, re-attachable snap engagement with the insertion end (i.e., trailing end) of the connector body for securing the cable in the connector body. The cable may be terminated to the connector by inserting the cable into the locking sleeve or the locking sleeve may be detachably removed from the connector body and the cable inserted directly into the connector body with the locking sleeve detached subsequently.

The skilled artisan will appreciate that it would be an advancement in the art to provide a male coaxial cable connector, particularly a connector operable for attachment to, but not limited to, F-type, BNC and RCA-type female fittings, wherein a single such male coaxial cable connector can be securely attached to coaxial cables in a conventional manner (i.e., compression) even when different cables having different outer diameters are employed.

With the increased use of internet and pay-per-view digital services on cable TV systems, it is desirable to have a higher level of shielding on coaxial cables in order to prevent ingress of RF noise. In large cities, where RF noise is a problem, cable companies have begun using a coaxial cable having the same diameter dielectric layer (RG-6 for example) but with the thickness of the overlying shield increased from a double shielding to triple or quad shielding. These additional shielding braids make the outer diameter of the cable larger, thereby requiring a cable installer to have access to a variety of connectors in order to ensure that a connector is available that can be securely attached to each cable.

Holland (the present inventor), in U.S. Pat. No. 7,008,263, the content and teaching of which patent is incorporated herein by reference thereto, discloses a reusable male coaxial cable connector comprising a connector nut affixed to the leading end of a tubular shank, the tubular shank having a trailing end extending rearwardly from the connector nut. The connector further comprises a tubular body portion concentrically mounted to overlie the tubular shank. The tubular body portion has a leading end rotatably (or nonrotatably) connected to the connector nut, and a trailing end in opposition thereto, the tubular body portion having a first axial conduit. The connector also includes a compression sleeve having a leading end and a second axial conduit slidably and removably disposed within the first axial conduit, and a deformable compression ring removably disposed within the first axial conduit forward of the leading end of the compression sleeve.

The connector described in the '263 patent is, in certain situations, difficult to use. The disposition of the compression sleeve within the first axial conduit of the tubular body portion renders it difficult for an installer to grip the compression sleeve for removal from the connector in the event that it is desired to replace the deformable compression ring with a compression ring that has a more preferred inner diameter for the particular cable to which the connector is to be affixed. There is a need for a coaxial cable connector similar to the connector described in the aforesaid '263 patent but wherein the compression sleeve is disposed on the connector in such a way that the compression sleeve is easy for an installer to grip for removal and/or for a tool to grip for compression.

SUMMARY

The present invention provides a compression-type coaxial cable connector. The connector generally includes a connector (or "adapter") nut having a leading end adapted for releasable connection to a mating female port, and a trailing end in opposition to the leading end. The connector further comprises a tubular body portion having first axial conduit with a tubular shank coaxially mounted therewithin attached to the trailing end of the connector nut. The tubular (or slotted) body portion has a second axial conduit having a deformable compression ring removably disposed therewithin. A tubular compression sleeve is slidably and removably (i.e., detachably/reattachably) disposed to overly at least the trailing end of the tubular body portion. The compression sleeve has a third axial conduit wherein the leading end of the third axial conduit is dimensioned to snugly overlie the outer diameter of the tubular body portion, and wherein the diameter of the third axial conduit is stepped or ramped, having a smaller diameter in the trailing end than in the leading end. The inner surface of the compression sleeve has first detent means preferably comprising a first annular ridge thereon adjacent the leading end thereof. The tubular body portion preferably includes a first annular groove projecting radially inwardly from the outer surface thereof. When the leading end of the compression sleeve is advanced forwardly over the tubular body portion, the first annular groove on the outer surface of the tubular body portion releasably engages the first annular ridge on the compression sleeve to form a compressible coaxial cable connector assembly having "semi integral" construction in the sense that although the compression sleeve is removable, it is loosely held to the outer surface of the connector body by detent means unless intentionally removed such as in the event it is necessary to replace the compression ring with a compression ring having an axial conduit with a different inner diameter. The term "detachable", as used herein to describe a compression sleeve, means that the compression sleeve may be facilely detached and removed from the connector and reattached thereto without damaging either the compression sleeve or the connector body.

The tubular body portion of the connector has a barbed ferrule (referred to herein alternatively as a "center post" or "tubular shank") disposed axially therewithin. In accordance with the prior art, the barb is disposed adjacent the trailing end of the ferrule. The tubular shank has an open trailing end. When the prepared end of a coaxial cable is inserted into the trailing end of the compression sleeve conduit, and advanced forwardly through the axial conduit in the compression sleeve, the compression ring and the tubular body portion of the connector, the trailing end of the ferrule or tubular shank forces the cable jacket and braid over the relatively low profile barb into an annular space between the ferrule and the compression sleeve to overlie the tubular shank forward of the barb as well as over the barb. The cable is further advanced into the connector until the leading end of the braided shielding can be advanced no further.

When it is determined that the prepared end of the coaxial cable is fully advanced into the first axial conduit within the body portion, subsequent advancement of the compression sleeve over the body portion deforms the trailing end of the compression ring radially inwardly which compresses the cable jacket between the compression ring and the tubular shank forward of the barb on the tubular shank. Further advancement of the compression sleeve is terminated when a second detent means preferably comprising an annular groove in the outer surface of the tubular body portion "snaps" into, and nonreleasably engages, a second annular ridge in the inner surface of the compression sleeve. The jacket and braided shielding of the cable are compressed between the deformed portion of the compression ring and the barbed ferrule thereby providing secure connection between the cable and the connector.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
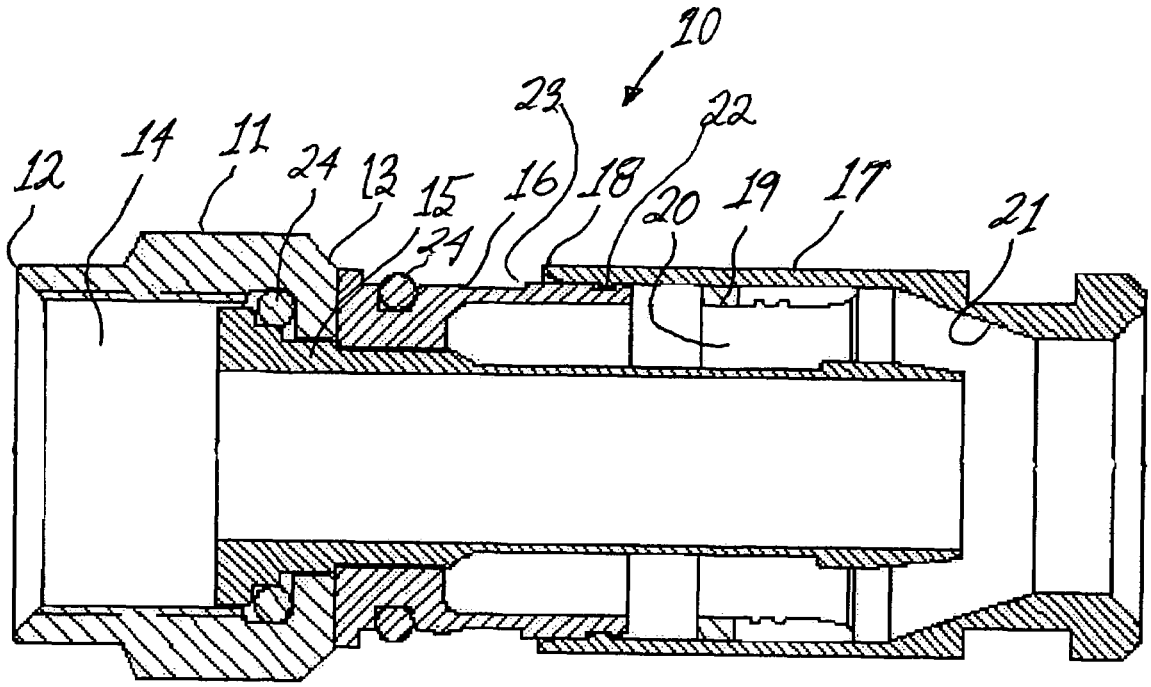
FIG. 1 is a longitudinal cross-sectional view of a coaxial cable connector in accordance with a second embodiment of the present invention prior to the insertion of a coaxial cable thereinto and subsequent compression, the Figure illustrating the shape and disposition of the interchangeable compression ring within the axial bore of the tubular body portion sleeve.

Prior to attaching a coaxial cable to a male connector, the end of the cable that will be receiving the connector must first be prepared. It will be understood by the artisan that the preparation of the end of the cable will be in accordance with the type of male coaxial cable connector that the cable will be attached (i.e., F-type, BNC, RCA, etc.) as discussed in U.S. Pat. No. 7,008,263, the content and teaching of the patent being incorporated herein by reference thereto. In order to prepare the end of a coaxial cable to receive a male connector, a cutting tool is used by an installer to expose a portion of the central conductor, a length of the dielectric core and a conductive (grounding) braid. The respective lengths of each of the elements comprising the coaxial cable that are exposed by the cutting tool will depend on the particular type of male connector to be attached thereto and are in accordance with industry standards. Following exposure of the conductive braid, the exposed portion of conductive braid is flared and folded back to overlie the protective jacket in a manner well known in the art. The thickness of the conductive braid may vary, depending on the manufacturer, and require the application of different amounts of force by the installer in order to correctly position the cable end within the connector prior to attachment. It is an important advancement in the art that the axial conduit in both the tubular body portion and compression ring of the present connector may be substantially larger than the outer diameter of the cable while maintaining secure attachment of the connector to the cable as will be discussed below.

It is advantageous to have one connector that can be used for all sized braid thickness within a family of RG-6 or RG-59 cables which are the typical CATV cables. Therefore, it is desirable to provide a male coaxial cable connector that will work well with a variety of cable braid sizes within a type of cable. Though manufacturers have approached this problem in different ways, the present invention provides a modification of the coaxial cable connector disclosed in U.S. Pat. No. 7,008,263 that enables the modified connector to be attached to a variety of cable thicknesses.

In accordance with the prior art, connectors are known wherein the connector includes a fixed compression ring attached to the connector body. The inside diameter of the ring determines the largest size cable that can be used. If the inner diameter is sized for the largest size cable, then the smaller OD cable will not be clamped and held by this section of the connector. To solve this problem, and to provide a universal connector, the present invention detaches the (formerly fixed) compression ring, allowing the user to insert a properly sized compression ring for the braid and cable in use.

As mentioned earlier, the coaxial cable connector described in U.S. Pat. No. 7,008,263 includes a removable compression ring that enables a single connector to be used with a variety of cables. A disadvantage of the connectors disclosed in '263 is that because the compression sleeve is slidably disposed within the axial bore of the body portion, the portion of the connector sleeve that can be grasped for separating the compression sleeve from the tubular connector body portion is limited, rendering it difficult for an installer to change compression rings. This problem is obviated by disposing the compression sleeve to overlie the body portion, thereby exposing a greater surface area of the compression sleeve for grasping. A coaxial cable connector having a replaceable compression ring and an accessible (i.e., graspable) compression sleeve in accordance with the present invention is illustrated in FIGS. 1 and 2.

With reference to FIG. 1, a coaxial cable connector is illustrated in longitudinal cross-sectional view at numeral 10 in an uncompressed (i.e. unconnected) configuration. For clarity, the cable is not shown in the Figures. The method for inserting the prepared end of a cable into the trailing end of the connector 10 is discussed in the '263 patent and need not be repeated here. The connector 10 comprises an adapter nut 11 having a leading end 12, a trailing end 13 and an axial bore 14. The leading end of a tubular shank 15 is attached to the adapter nut 11 and extends rearwardly therefrom. The leading end of the connector body portion 16 is also attached, either rotatably or nonrotatably, to the adapter nut 11 at the leading end thereof and concentrically overlies the tubular shank 15. The connector 10 further includes a removable compression sleeve 17 having a leading end 18 that is releasably attached to the outer surface of the connector body portion 16 by detent means. A deformable compression ring 19 is removably disposed within the axial bore 20 of the compression sleeve 17 prior to connection of the compression sleeve 17 to the connector body portion 16.

Figure 2:
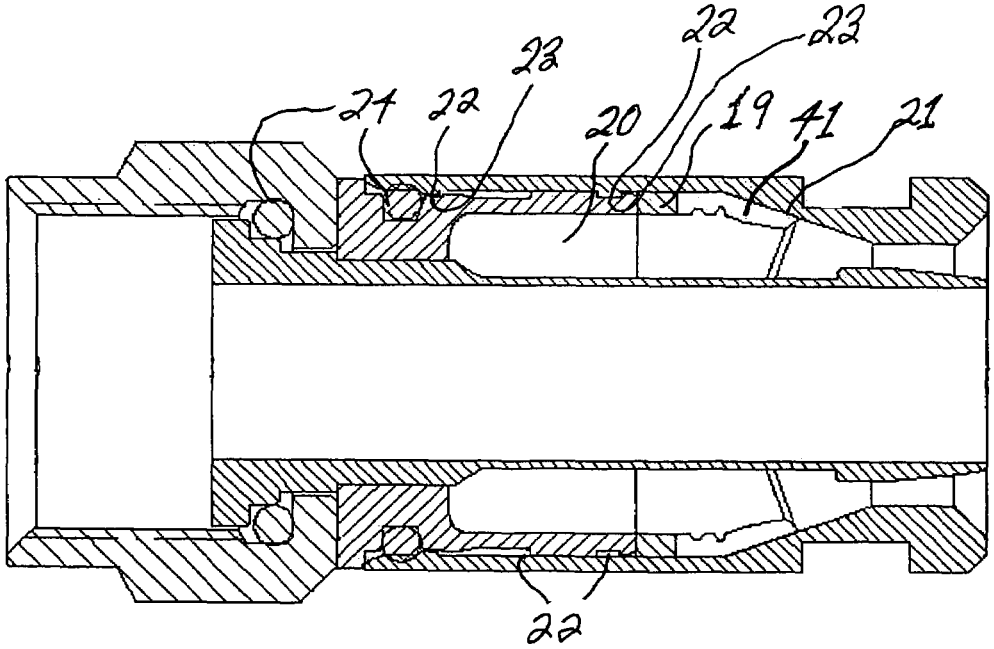
FIG. 2 is a longitudinal cross-sectional view of the coaxial cable connector in accordance with FIG. 1 after compression, the Figure illustrating the deformation of the compression ring within the axial bore of the body portion following compression thereof by advancement of the compression sleeve over the trailing end of the tubular body portion.

FIG. 2 is a longitudinal cross-sectional view of the coaxial cable connector 10 in accordance with FIG. 1 after compression thereof by a suitable compression tool (not shown). Again, the cable is not shown for clarity. The manner of insertion and the disposition of the prepared end of a coaxial cable within the connector prior to compression of connector 10 will be obvious to the artisan. FIG. 2 illustrates the deformation of the compression ring 19 within the axial bore 20 of the compression sleeve 17 following compression of the connector 10 by advancement of the compression sleeve 17 over the trailing end of the tubular body portion 16. With reference to both FIGS. 1 and 2, when the compression sleeve 17 is advanced over the trailing end of the connector body portion in the direction of the arrow, the compression ring 17 advances until it abuts the trailing end of the connector body portion 17. Due to the beveled or ramped inner diameter 21 of the compression sleeve 17, further advancement of the compression sleeve forces the (preferably slotted) trailing end of the compression ring 19 inwardly against the cable (not shown), as illustrated in FIG. 2. When the compression sleeve 17 is fully advanced, an annular ridge 22 on the inner circumference of the compression sleeve 17 lockingly engages an annular groove 23 on the outer circumference of the connector body, compressing "O" rings 24 to form a watertight seal.

Figure 3:
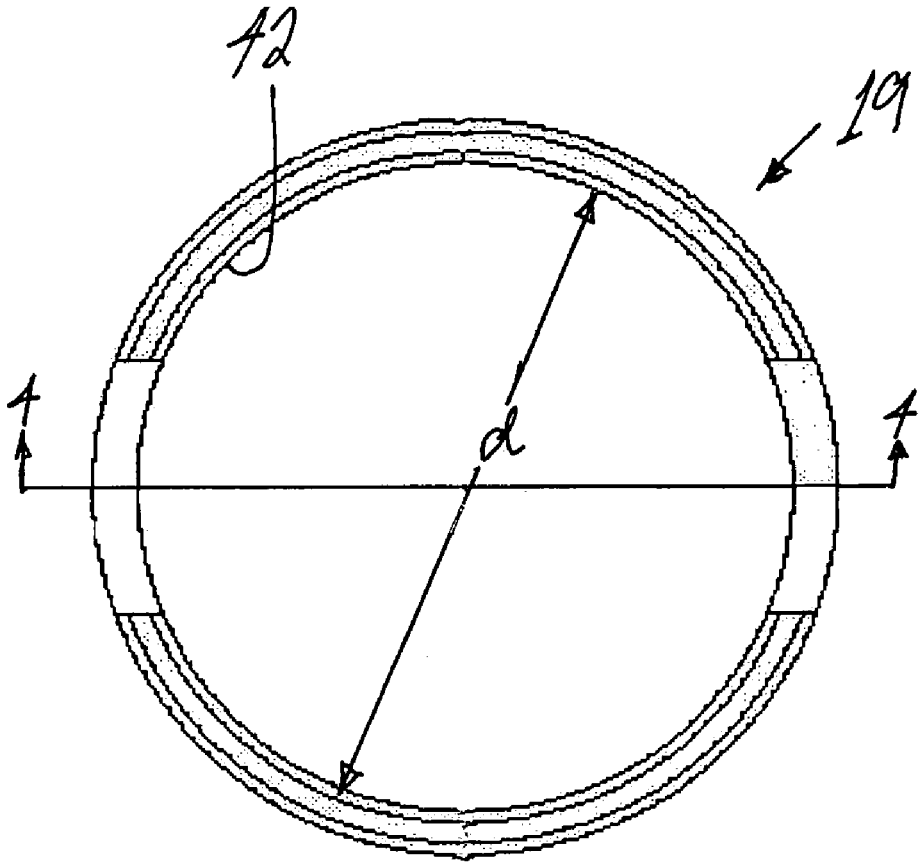
FIG. 3 is a top view of an exemplary replaceable compression ring having an outer diameter that permits the ring to fit snugly within the axial bore in the connector body portion of the coaxial cable connector of the present invention.
Figure 4:
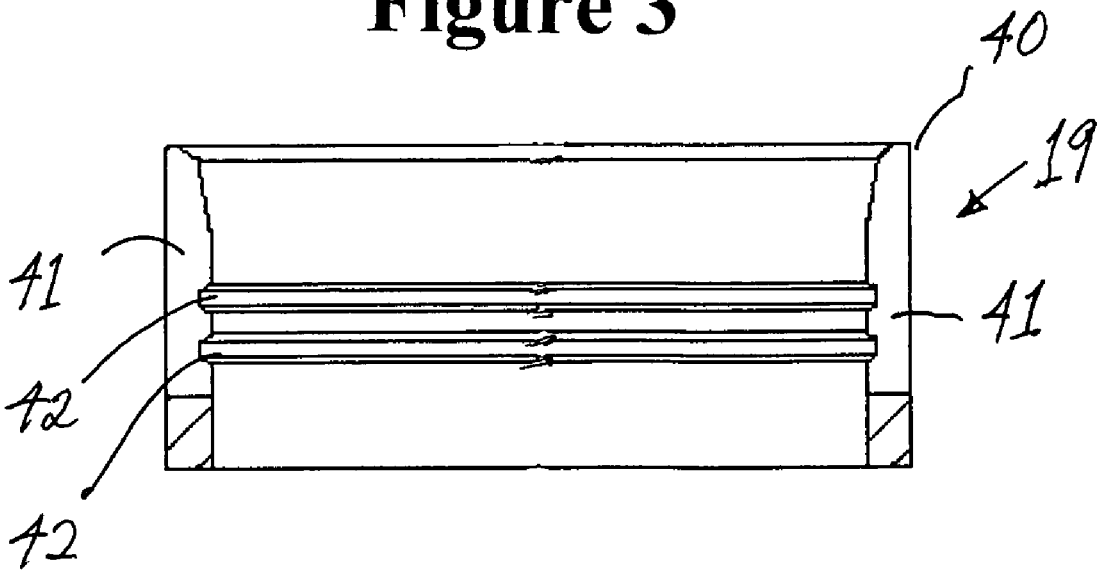
FIG. 4 is a cross-sectional side view of the compression ring of FIG. 3.

FIG. 3 is a top view of an example of a deformable compression ring suitable for use with the connector 10 of FIGS. 1 and 2. FIG. 4 is a cross-sectional view of the compression ring 19 taken along section line 4-4 of FIG. 3. The trailing end 40 of the compression ring is deformable inwardly and preferably has a plurality of slots 41 therein to facilitate controlled deformation. The compression ring 19 may be provided in a variety of inner diameters d, and a fixed outer diameter which may be inserted into the axial conduit 20 in the compression sleeve 17 prior to attachment of the connector 10 to a cable. The deformable trailing end 40 of the compression ring 19 preferably has a plurality of ridges 42 thereon to assist with gripping the cable. It should be clear to the artisan that the compression sleeve 17 may be supplied with the correct ring 19 (i.e., the compression ring having a diameter d which is slightly greater than the outer diameter of the prepared end of the coaxial cable) preinstalled therewithin, or the compression ring 19 can be provided in a variety of diameters d for insertion into the connector sleeve 17 prior to installing the connector 10 on a cable. The user may either remove the compression sleeve and insert a newly sized ring or purchase the connector with the ring separate for easy field use once the cable size is selected.

While particular embodiments of the present invention have been illustrated and described, it would be obvious to those skilled in the art that various other changes and modifications can be made without departing from the spirit and scope of the invention. The critical features of the present invention are, in one aspect, the provision of a male coaxial cable connector having a removable compression ring with a deformable trailing end slidably disposed within an axial conduit of the compression sleeve. The compression sleeve is slidably mounted over the outer surface of the connector body portion thereby providing maximum grasping surface for the installer to remove the compression sleeve from the connector in the event that the compression ring is to be replaced. Accordingly, the compression sleeve and connector body, in combination, may be used with any coaxial cable connector if used in the manner disclosed by the present invention. It is therefore intended to cover in the appended claims all such changes and modifications that are within the scope of this invention.

What I claim is:

1. A reusable male coaxial cable connector comprising a connector nut, a tubular shank having a leading end attached to a trailing end of said connector nut and a trailing end extending rearwardly from said connector nut, a tubular connector body portion concentrically mounted to overlie said tubular shank, said tubular connector body portion having a leading end attached to said connector nut and a trailing end extending rearwardly therefrom, a tubular compression sleeve having an axial conduit and a leading end slidably and removably disposed over an outer surface of said trailing end of said connector body portion, and a deformable compression ring removably disposed within said axial conduit of said compression sleeve wherein said compression ring is a tubular member having a plurality of slots in a trailing end thereof.

* * * * *